US006491186B1

(12) United States Patent
Wiggins

(10) Patent No.: US 6,491,186 B1
(45) Date of Patent: Dec. 10, 2002

(54) BUSINESS CARD DISPENSER WITH COUNTER AND EMPTY INDICATOR

(76) Inventor: Curtis D. Wiggins, 7302 Corporate Dr., #1919, Houston, TX (US) 77036

( * ) Notice: Subject to any disclaimer, the term of this patent is extended or adjusted under 35 U.S.C. 154(b) by 331 days.

(21) Appl. No.: 09/885,262

(22) Filed: Aug. 21, 2000

(51) Int. Cl.[7] ..... G07F 11/00

(52) U.S. Cl. ..... 221/2; 221/3; 221/6; 221/232; 221/259; 221/270; 206/39.4

(58) Field of Search ..... 221/3, 6, 185, 221/259, 270, 268, 232, 2; 206/39.4, 38, 37, 39

(56) References Cited

U.S. PATENT DOCUMENTS 599,821 A * 3/1898 Adkins
1,011,981 A * 12/1911 McCulloch
1,734,644 A * 11/1929 Ostrander et al.
1,791,586 A * 2/1931 Todd
3,260,402 A * 7/1966 Lareau et al.
4,792,058 A * 12/1988 Parker ..... 221/232
4,887,739 A * 12/1989 Parker ..... 221/232
5,615,800 A * 4/1997 Meyers ..... 221/232
6,050,449 A * 4/2000 Kanj ..... 221/232
6,082,581 A * 7/2000 Anderson et al. ..... 221/232

* cited by examiner

*Primary Examiner*—David H. Bollinger
(74) *Attorney, Agent, or Firm*—Randal D. Homburg

(57) ABSTRACT

The invention is a business card dispenser that dispenses a single card using a sliding button which has a card counter and a means of indicating when the business card dispenser is empty.

7 Claims, 2 Drawing Sheets

BUSINESS CARD DISPENSER WITH COUNTER AND EMPTY INDICATOR

CROSS REFERENCE TO RELATED APPLICATIONS

None.

I. BACKGROUND OF INVENTION

1. Field of the Invention

The invention is a business card dispenser that dispenses a single card using a sliding button which has a card counter and a means of indicating when the business card dispenser is empty.

2. Description of Prior Art

The following United States patents are identified, disclosed and incorporated herein. Several devices are disclosed relating to business card dispensers. U.S. Pat. No. 6,050,449 discloses a business card dispenser having a reciprocating ejector mechanism and a drawer containing a stack of business cards. An information dispenser and a business card dispenser are included in U.S. Pat. No. 5,615,800 to Meyers. In U.S. Pat. No. 4,792,058 to Parker, a side slide mechanism is disclosed to allow the contained business card to be displayed through the top of the dispenser and ejected a single card at a time.

II. SUMMARY OF THE INVENTION

The primary objective of this invention is to provide a business card dispenser which dispenses a single card in a contained stack by way of a simple slide button, has a means for counting the cards dispensed by the user and also has a means of indicating when the business card dispenser is empty.

III. DESCRIPTION OF THE DRAWINGS

The following drawings are informal drawings submitted with this provisional patent application.

IV. DESCRIPTION OF THE PREFERRED EMBODIMENT

Figure 1:
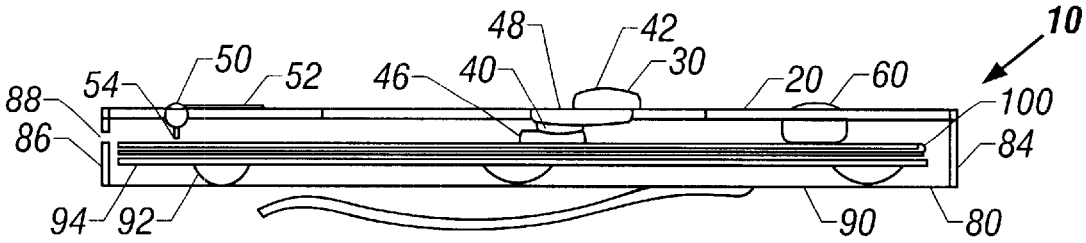
FIG. 1 is a side cross-section of the invention.

The invention, as shown in FIGS. 1–5 of the drawings is a business card dispenser 10 having a top lid section 20, a bottom card storage section 80, a slide means 30 for retractable dispensing of a stack of contained business cards 100 through a card dispenser slot 88, a means 50 for counting the number of business cards dispensed and a means 60 for visibly and audibly indicating when the business card dispenser 10 is out of business cards 100.

The top lid section 20 is attached to the bottom card storage section 80 by hinges 22. The top lid section 20 has an upper surface 24 and a lower surface 26. The upper surface 24 of the top lid section 20 contains the slide means 30, the means 50 for counting the number of card dispensed and the means 60 for visibly and audibly indicating when the invention is out of business cards, as shown in FIG. 2 of the drawings.

Figure 2:
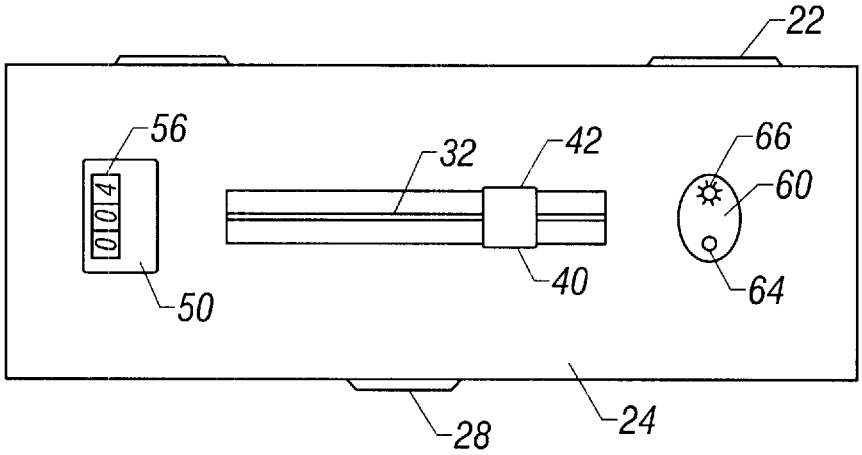
FIG. 2 is a top view of the invention.
Figure 3:
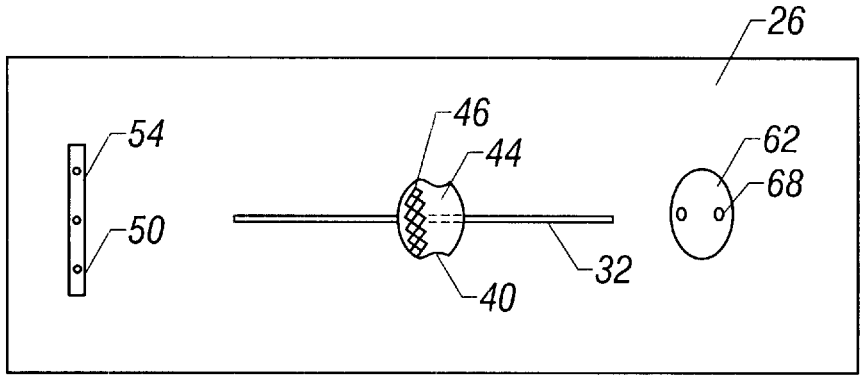
FIG. 3 is an underside view of the top lid section of the business card dispenser.
Figure 4:
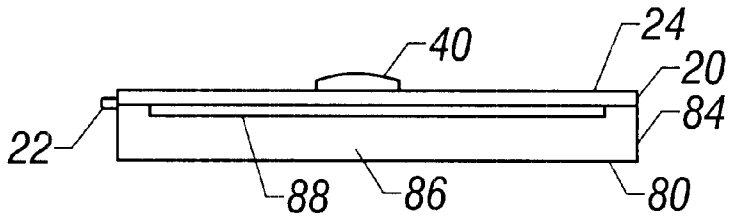
FIG. 4 is an end view of the invention showing the card dispenser slot.

One embodiment of the slide means 30, as shown in FIGS. 1–3 of the drawings, may include a linear slot 32, a slide button 40 having a contoured upper surface 42 to accommodate a user's thumb extending above the upper surface 24 of the top lid section 20, a rubber friction plate 46 on a lower portion 44 of the slide button 40 to contact a top business card in the stack of business cards 100 within the invention 10, and a neck 48 between the contoured upper surface 42 and the lower portion 44 engaged within the linear slot 32. As the contoured upper surface 42 is depressed, the rubber friction plate 46 engages the top business card and as the slide button 40 is moved down the linear slot 32, the top business card is urged in the direction of the moving slide button 40.

An embodiment of the means 50 for counting the number of card dispensed, as shown in FIGS. 1–3 of the drawings, may include a rachet counting mechanism 52 with a pivoting activator member 54 which is moved forward as a card is dispensed and moves back into a resting position when the card is removed, each movement advancing a digital counter 56 one numerical increment per card dispensed. This embodiment may count forward or reverse number sequences.

Figure 5:
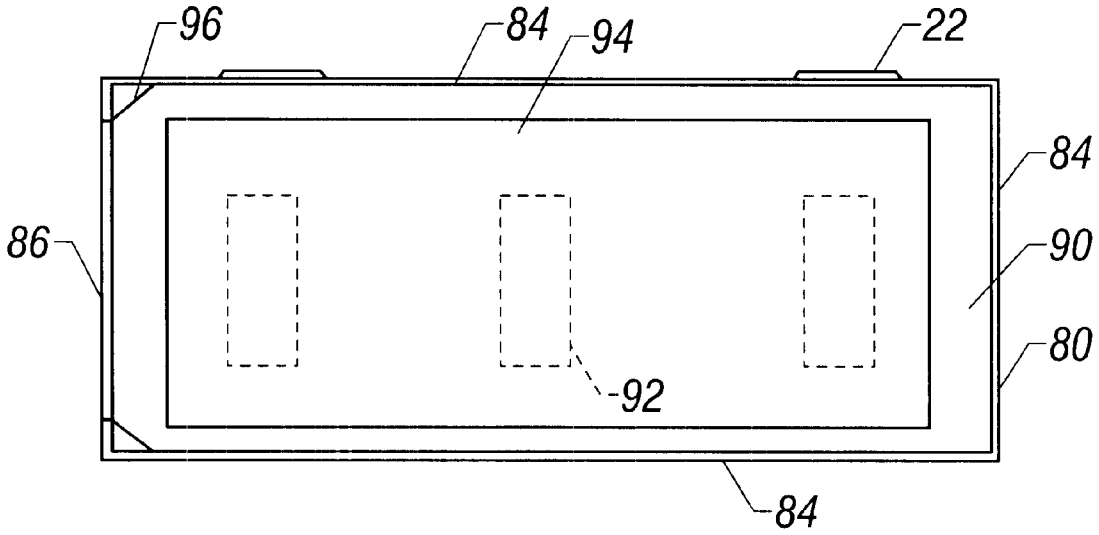
FIG. 5 is a top view of the bottom card storage section of the invention.

The bottom card storage section 80 of the invention, as shown in FIG. 5 of the drawings, has a bottom 90, three sides 84 and a fourth side 86 containing the card dispenser slot 88. The bottom 90 contains a plurality of spring plates 92 upon which is attached a card tray 94 whereupon the stack of business cards 100 is placed. The bottom 90 also has guide elements 96 to guide the business cards 100 to the card dispensing slot 88. The spring plates 92 urge the card tray 94 in an upward direction to present the stack of business cards 100 upwards in the bottom card storage section 80, wherein the top business card in the stack is moderately forced against the rubber friction plate 46 when the bottom card storage section 80 and the top lid section 20 are closed by a closing catch 28.

In an embodiment of the invention the card tray 94 is metal and the means 60 for visibly and audibly indicating when the business card dispenser 10 is out of business cards 100 is provided by a low-voltage microchip cell 62 containing a beeper 64 and an LED indicator 66 having the beeper 64 and LED indicator 66 presented on the upper surface 24 of the top lid section 20 of the invention 10. A pair of electrical contacts 68 is provided on the low-voltage microchip cell 62 extending below the lower surface 26 of the top lid section 20 of the invention 10. When business cards 100 are located in the invention, the pair of electrical contacts 68 are not allowed to complete a circuit 70. When the last business card is removed, the card tray 94, made of metal in this embodiment, fulfills the electrical connection between the pair of electrical contacts 96 completing the circuit 70 and activating the beeper 64 and the LED indicator 66 to alert the user that there are no more business cards 100 to be dispensed.

Although the embodiments of the invention have been described and shown above, it will be appreciated by those skilled in the art that numerous modifications may be made therein without departing from the scope of the invention as herein described.

What is claimed is:

1. A business card dispenser including:

a lower member for storing business cards therein;

an upper member coupled to the lower member so that a card dispensing slot is formed between the upper and the lower members;

means slidably mounted in the upper member for dispensing cards through the card dispensing slot;

means for counting the number of cards dispensed through the card dispensing slot; and means for indicating when all the cards in the lower member have been dispensed.

2. A business card dispenser as defined in claim 1 wherein the lower member for storing business cards therein includes:

a rectangular shaped base member;

a first side wall coupled to one side of the base member;

a second side wall spaced from the first side wall coupled to the other side of the base member;

a third wall coupled to the outermost ends of the first and second side walls; and a fourth wall coupled to the other outermost ends of the first and second side walls.

3. A business card dispenser as defined in claim 2 wherein the means for storing business cards therein further includes:

a card tray aligned adjacent the base member for holding business cards therein;

a plurality of spring members coupled between the base member and the card tray for biasing the card tray in an upward direction to facilitate dispensing of the cards from the tray; and a pair of spaced guide members coupled to the base member in adjacent alignment with the dispensing slot so that a card in the card tray is guided into the slot.

4. A business card dispenser as defined in claim 3 wherein the upper member has an elongated linear slot formed therein.

5. A business card dispenser as defined in claim 4 wherein the card dispensing means includes:

a first upstanding member mounted for linear slidable movement in the linear slot formed in the upper member; and a friction member coupled to a lower portion of the upstanding member to engage an uppermost card in the card tray so that when the upstanding member is moved in a predetermined direction the uppermost card in the card tray is moved into the card dispensing slot.

6. A business card dispenser as defined in claim 5 wherein the counting means includes:

a racket counting member, and means pivotably coupled to the counting member for activating the counting member each time a card is dispensed through the card dispensing slot.

7. A business card dispenser as defined in claim 6 wherein the indicating means includes a means for visibly and audibly indicating when all the cards in the card tray have been dispensed.

* * * * *